US006296597B1

(12) United States Patent
Schöne et al.

(10) Patent No.: US 6,296,597 B1
(45) Date of Patent: Oct. 2, 2001

(54) EXERCISE DEVICE WITH PARALLELOGRAM STRUCTURE HAVING MOVABLE LONGITUDINAL BARS

(76) Inventors: Dirk Schöne, Lutzenbergerstrasse 33, D-73635, Rudersberg (DE); Rados Vitorovic, Burgstrasse 46, D-70734, Fellbach (DE)

( * ) Notice: Subject to any disclaimer, the term of this patent is extended or adjusted under 35 U.S.C. 154(b) by 0 days.

(21) Appl. No.: 09/311,012

(22) Filed: May 13, 1999

(30) Foreign Application Priority Data

May 14, 1998 (DE) ..... 298 08 727 U

(51) Int. Cl.[7] ..... A63B 21/008

(52) U.S. Cl. ..... 482/111; 482/51; 482/53; 482/148

(58) Field of Search ..... 482/51, 52, 53, 482/111, 112, 114, 115, 57, 62, 133, 135, 54, 148, 907

(56) References Cited

U.S. PATENT DOCUMENTS

Re. 36,031 * 1/1999 Piaget et al. ..... 482/51
4,390,178 * 6/1983 Rudell et al. ..... 482/77
4,779,863 * 10/1988 Yang ..... 482/51
5,199,932 4/1993 Liao .
5,575,739 * 11/1996 Piaget et al. ..... 482/51
5,595,555 * 1/1997 Chen ..... 482/51
5,679,100 10/1997 Charnitski .
5,711,749 * 1/1998 Miller ..... 482/135
6,042,510 * 3/2000 Miller ..... 482/51

FOREIGN PATENT DOCUMENTS 404322 3/1998 (DE) .

* cited by examiner

*Primary Examiner*—Justine R. Yu
(74) *Attorney, Agent, or Firm*—Kriegsman & Kriegsman

(57) ABSTRACT

The present invention concerns a sports or exercise device comprising a mounting frame and a parallelogram having left and right longitudinal bars and upper and lower cross bars, wherein the longitudinal bars are movable vertically and parallelly to one another against at least one resistance element or weight. A left hand grip and a left treading surface are assigned to the left longitudinal bar, and a right hand grip and a right treading surface are assigned to the right longitudinal bar, such that the movement of the parallelogram results in a forward movement of the left hand grip and left treading surface, or a backward motion of the right hand grip and the right treading surface.

19 Claims, 7 Drawing Sheets

EXERCISE DEVICE WITH PARALLELOGRAM STRUCTURE HAVING MOVABLE LONGITUDINAL BARS

BACKGROUND OF THE INVENTION

Sports and fitness devices, such as they are used, for example, as home equipment or in fitness studios, are generally designed in such a way that specific muscle groups are stressed in a targeted manner. For training at home or in the fitness studio, a large number of special apparatus is necessary, if one wishes to work the entire body uniformly. This is particularly a disadvantage if one would like to train at home because purchasing various training devices often is limited by the high price of such equipment and lack of space.

The object of the present invention is to present a sports device, with which several different muscle groups can be stressed or worked simultaneously.

SUMMARY OF THE INVENTION

The invention comprises a sports or exercise device with a mounting frame and a parallelogram structure with left and right longitudinal bars and upper and lower crossbars, whereby the longitudinal bars can be moved vertically and parallely relative to one another against at least one resistance and/or at least one weight. A left hand grip and a left treading surface are assigned to the left longitudinal bar and a right hand grip and a right treading surface are assigned to the right longitudinal bar, in such a way that the movement of the parallelogram structure results in a forward motion of the left hand grip and the left treading surface and a reverse motion of the right hand grip and the right treading surface, and vice versa.

The construction of the device according to the invention thus leads to a course of movement in which simultaneously the left leg and the left arm are moved upward and the right leg and the right arm are moved downward, and in fact, against a weight. Either only the arms or only the legs, or both the arms and legs can be simultaneously worked against the weight. The course of movement is comparable with climbing stairs or mountain climbing. Thus, the musculature of the arms, the legs, the back, the chest and the shoulder girdle as well as the buttocks region can be worked simultaneously.

The sports device according to the invention can be produced in different sizes and constructed such that it can be easily disassembled and reassembled. The present device is particularly suitable for home use. However, it may also be used in a larger setting, e.g., as a professional training device, for example, in fitness studios. The present device also may be used for medical purposes, such as for checking fitness or EKG measurement. According to the invention, almost all important muscle groups are stressed simultaneously, thus more precise results can be obtained with such measurements than with previously used home trainers such as stationary bicycle devices or stair climbing devices.

The arrangement of the hand grips and treading surfaces can be made in different ways. For example, the hand grips and treading surfaces may be attached directly to the parallelogram structure, for example to the longitudinal bars or to the cross bars. They also may be joined indirectly to the parallelogram by attaching them to one or more mounting elements, which in turn are attached to or joined with the parallelogram. In a currently preferred embodiment, these mounting elements, for aesthetic reasons, are shaped as equilateral triangles. However, any shape may be used, including, without limitation, squares, rectangles, circles or other triangular shapes.

The weight is preferably in the form of one or more pneumatic or hydraulic cylinders, whereby one of the ends of each cylinder is attached to the mounting frame and the other end of each cylinder is attached to the parallelogram or to one or more mounting elements. In this way, the parallelogram can be moved against the restoring force exerted by the cylinders.

Examples of embodiments of the present invention are explained in more detail below with reference to the attached drawings.

DETAILED DESCRIPTION

The construction of a first embodiment of the sports device according to the invention can be seen from a synopsis of FIGS. 1 to 4. This embodiment preferably is approximately 1.9 meters high, but can be designed appropriately smaller or larger.

Figure 1:
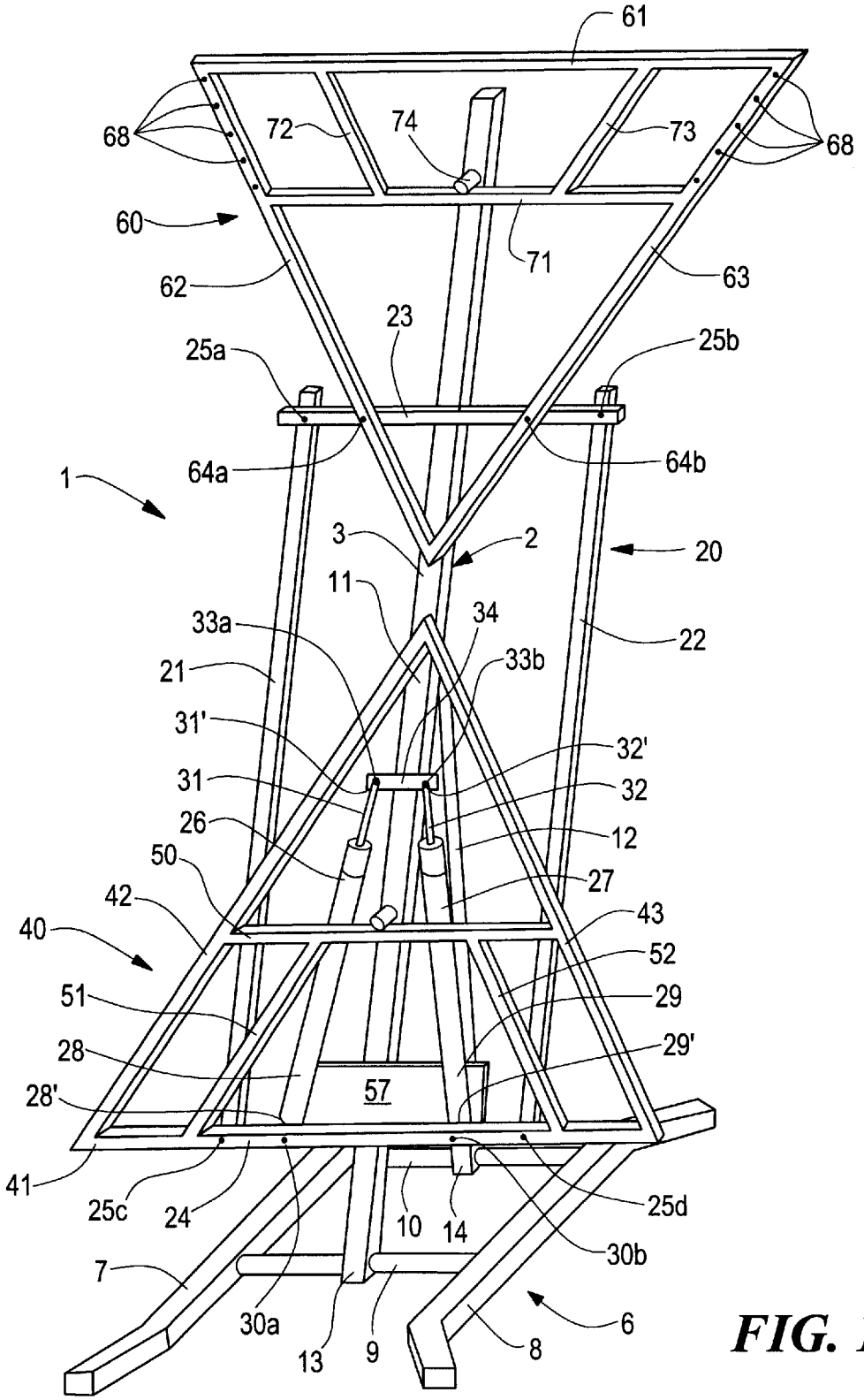
FIG. 1 is a schematic representation of a first embodiment of the present invention with a parallelogram and two triangles as upper and lower mounting elements for the hand grips and treading surfaces.
Figure 4:
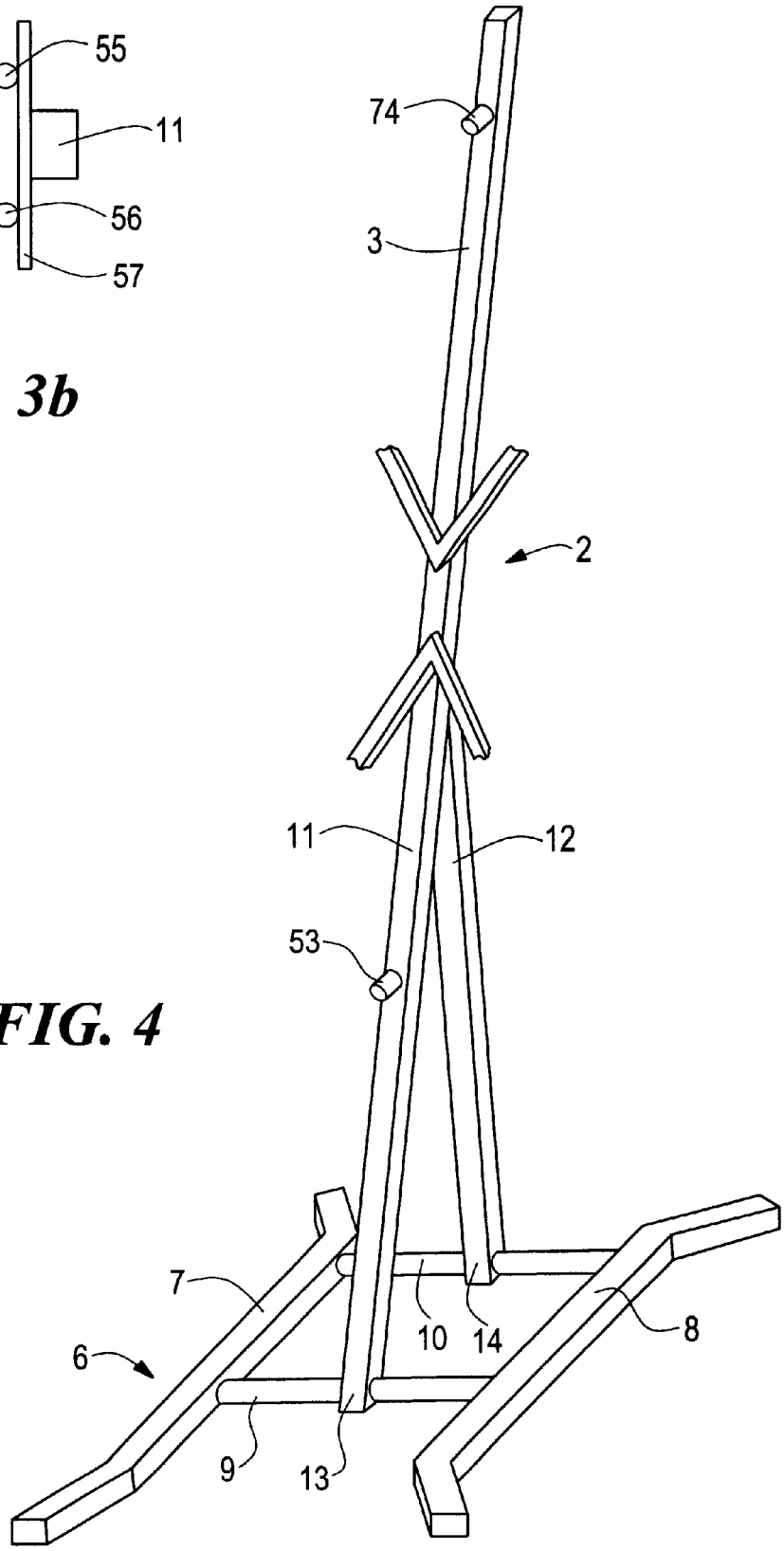
FIG. 4 shows a schematic representation of the mounting frame with two buttresses for the triangles.

FIG. 1 shows schematically the total device, but without treading surfaces and hand grips. The sports device 1 according to the invention has a mounting frame in the form of a support frame 2, which bears the other components (see FIG. 4). As shown in FIG. 4, the support frame 2 comprises a vertical mounting rod 3 and a pedestal 6. Pedestal 6 has two beams 7, 8, which are joined together by rungs 9, 10. The vertical mounting rod 3 and a front support 11 are inserted into one another and fixed. A back support 12 preferably is attached from behind at the vertical mounting rod 3 and/or at the front support 11. The vertical mounting rod 3, however, may open up also into a front support 11 and a back support 12. The free ends 13, 14 of front support 11 and back support 12 are joined rigidly with rungs 9, 10 of pedestal 6.

As shown in FIG. 1, the core piece of the sports device 1 is a parallelogram structure 20 having a left longitudinal bar 21, a right longitudinal bar 22, an upper cross bar 23, i.e., turned toward mounting rod 3, and a lower cross bar 24, i.e., turned toward supports 11, 12. The longitudinal bars 21, 22 and cross bars 23, 24 are joined together in a moveable manner at their ends by means of bearings 25*a*–25*d*.

Two hydraulic cylinders 26, 27 (FIG. 1) are provided as resistance or weight. The free ends 28', 29' of each cylinder housing 28, 29 are joined in a rotatable manner, each time by means of bearings 30*a*, 30*b*, with the lower cross bar 24 of parallelogram 20. The free ends 31', 32' of each cylinder piston 31, 32 are joined each time by means of bearings 33*a*, 33*b* with a carrier plate 24, which in turn is attached to the front support 11 of mounting frame 2. The restoring force exerted by cylinders 26, 27 can be manually controlled, if desired.

Figure 3A:
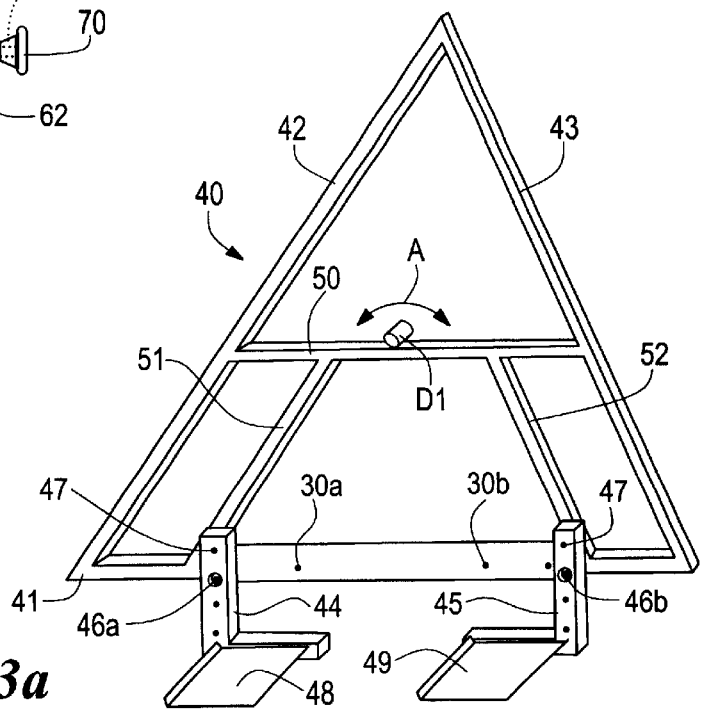
FIG. 3*a* shows a schematic representation of the lower triangle with two treading surfaces.

The lower cross bar 24 of parallelogram 20 is simultaneously part of an equilateral triangle 40 with a base 41 and two legs 42, 43 (see FIG. 3*a*). Base 41 of triangle 40 simultaneously forms the lower cross bar 24 of parallelogram 20 (see FIG. 1).

As shown in FIG. 3*a*, footrests 44, 45 are attached in a rotatable manner to bearings 46*a*, 46*b* to base 41. Footrests 44, 45 are provided with through boreholes 47, in which bearings 46*a*, 46*b* are inserted and fixed. A treading surface 48, 49 preferably is attached in a removable manner to each footrest 44, 45. The position of treading surfaces 48, 49 on footrests 44, 45, can be axially adjusted, therefore adjusted in width.

The footrests also may be attached to legs 41, 42 of triangle 40 or directly to the longitudinal or cross bars of parallelogram 20.

As shown in FIG. 3*a*, in a preferred embodiment, the lower triangle 40 has a cross carrying beam 50, which in turn is supported by two longitudinal carrying beams 51, 52 running parallel to legs 42, 43. A bearing socket 53, which defines a rotational axis D1 for triangle 40 lies substantially centrally on cross-carrying beam 50. The rotation of triangle 40 around axis of rotation D1 in the direction of arrow A results from the movement of the lower cross bar 24 of parallelogram 20. Bearing socket 53 is attached to the front support 11 of mounting frame 2 (see FIG. 4).

Figure 3B:
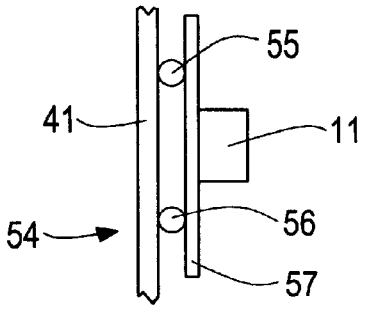
FIG. 3*b* shows a schematic top view onto a buttress arranged at the lower triangle.

Further, a buttress 54 at the back side of lower triangle 40 preferably is provided (see FIG. 3*b*). Buttress 54 has two rollers 55, 56, which are attached to the back side of base 41 of lower triangle 40, which is turned toward the front support 11 of mounting frame 2, as well as a rolling surface in the form of a plate 57, which is attached to front support 11. During the rotational movement of triangle 40 around its axis of rotation D1, rollers 55, 56 move over plate 57.

Figure 2A:
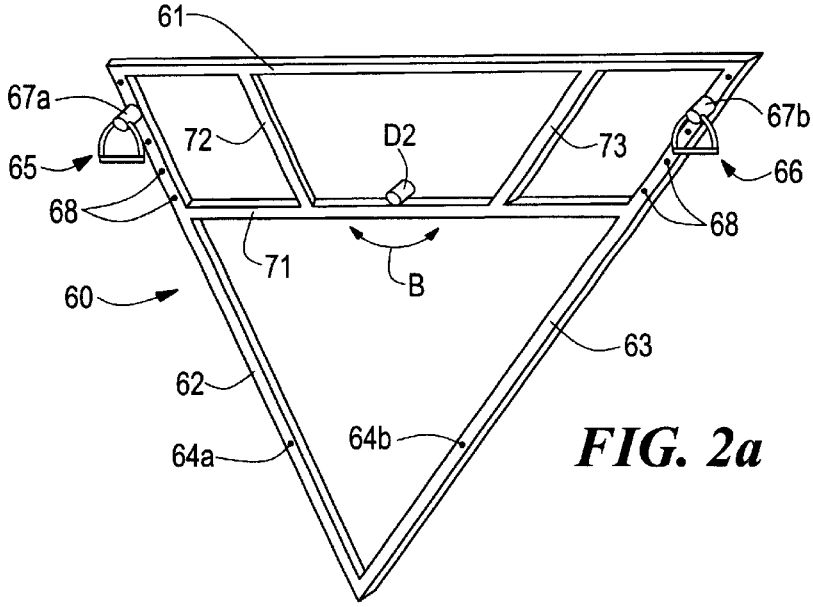
FIG. 2*a* shows a schematic representation of the upper triangle with two hand grips.

Another equilateral triangle 60 with a base 61 and two legs 62, 63 is provided on the upper cross bar 23 of parallelogram 20 (see FIGS. 1 and 2*a*). Triangle 60 is attached by legs 62, 63 by means of bearings 64*a*, 64*b* in a rotatable manner to upper cross bar 23.

As shown in FIG. 2*a*, hand grips 65, 66 are attached in a rotatable manner to bearings 67*a*, 67*b* on legs 62, 63. Legs 62, 63 are provided with through boreholes 68, in which bearings 67*a*, 67*b* are inserted and fixed. Several through boreholes 68 are provided, so that hand grips 65, 66 can be adjusted in height and can be adapted to the weight of the person who uses sports device 1.

Hand grips 65, 66, of course, could also be attached to base 61 of triangle 60 or directly to the longitudinal or cross bars of parallelogram 20.

Figure 2B:
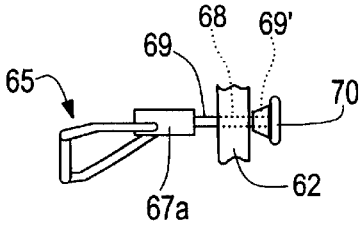
FIG. 2*b* shows a schematic side view of one hand grip.

FIG. 2*b* shows a hand grip 65 in detail. It is attached rigidly to bearing 67*a*. Bearing 67*a* in turn has a threaded rod 69 or a shaft with a thread. Threaded rod 69 is introduced into through borehole 68 in leg 62 of triangle 60 and is screwed with a lock nut 70 at its free end 69' and fixed in this way.

Upper triangle 60 preferably has a cross-carrying beam 71, which in turn is supported by two longitudinal carrying beams 72, 73 running parallel to legs 62, 63. A bearing socket 74, which defines an axis of rotation D2 for triangle 60, lies centrally on cross carrying beam 71. The rotation of triangle 60 around axis of rotation D2 in the direction of arrow B results from the movement of upper cross bar 23 of parallelogram 20. Bearing socket 74 is attached to vertical mounting rod 3 of mounting frame 2.

The sports device according to the invention can be completely taken apart and put together again, and thus can easily be transported.

Figure 5:
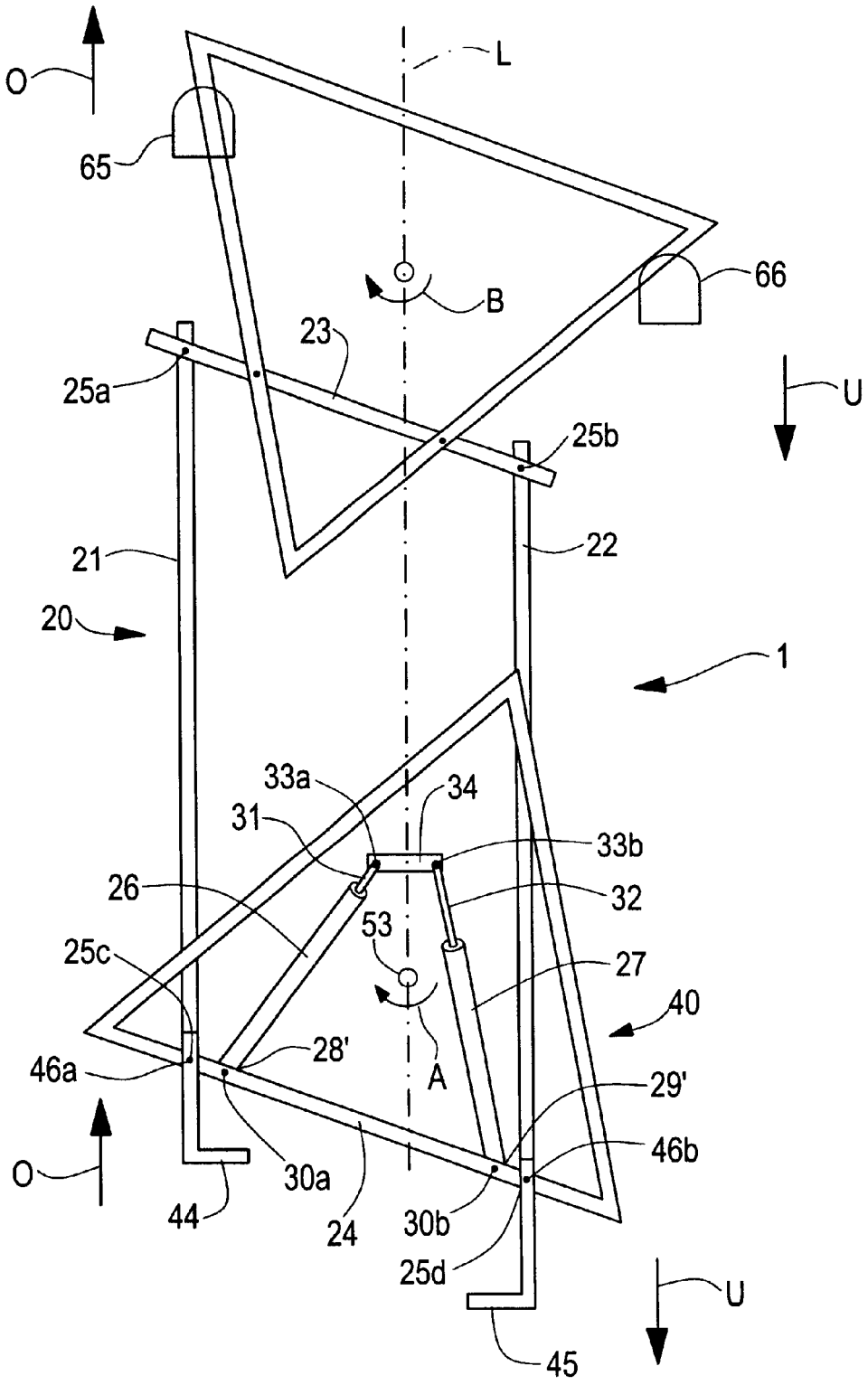
FIGS. 5 and 6 show schematic representations of the course of movement of the sports device according to the invention.
Figure 6:
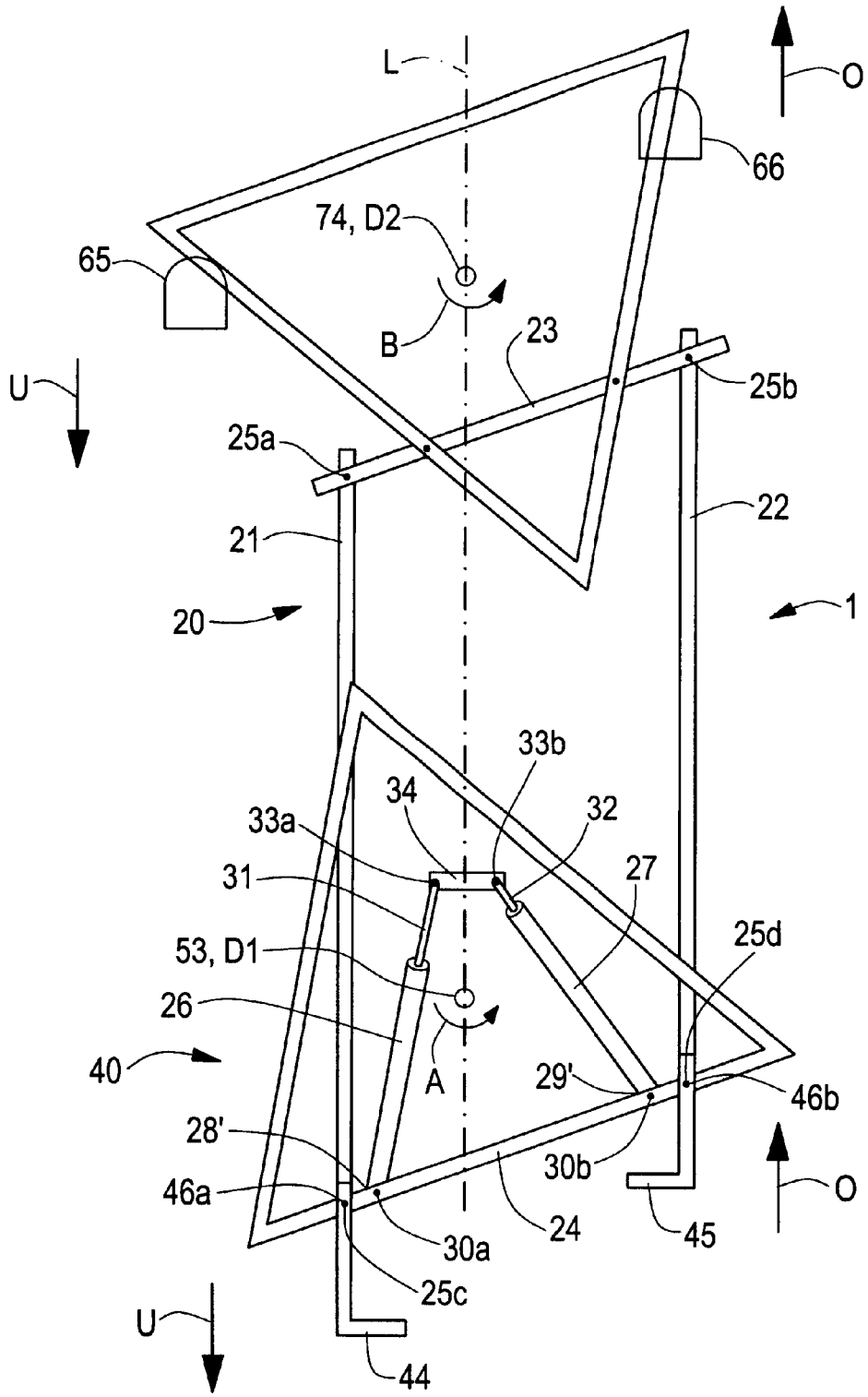

The course of movement with the use of the sports device 1 according to the invention can be seen from FIGS. 5 and 6. In the resting position, the sports device 1 assumes the position shown in FIG. 1, brought about by the restoring force of cylinders 26, 27. As shown in FIG. 5, vertical mounting rod 3 coincides with longitudinal axis L of parallelogram 20 and triangles 40, 60. The user of sports device 1 climbs up treading surfaces 48, 49 and holds onto hand grips 65, 66. A backward motion of right longitudinal bar 22 of parallelogram 20 is forced by exertion of the right arm and the right leg against the restoring force exerted by cylinders 26, 27 (see FIG. 5). This leads to a corresponding forward motion of left longitudinal bar 21 and to the corresponding inclination of cross bars 23, 24. In this way, triangles 40, 60 are rotated in the clockwise direction around their axes of rotation D1, D2. This leads to a backward movement U of the right hand grip 66 and the right footrest 45 or treading surface 49 and leads to a forward motion 0 of the left hand grip 65 and the left footrest 44 or treading surface 48. The movement also runs the opposite way, if the left arm and the left leg are exerted (see FIG. 6). Then a forward movement of the right longitudinal bar 22 of parallelogram 20 is forced against the restoring force exercised by cylinders 26, 27. This leads to a corresponding backward movement of left longitudinal bar 21 and to the corresponding inclination of cross bars 23, 24. In this way, triangles 40, 60 are rotated in the counterclockwise direction around their axes of rotation D1, D2. This leads to a forward movement O of the right hand grip 66 and the right footrest 45 or treading surface 49 and to a backward movement U of left hand grip 65 and left foot rest 44 or treading surface 48.

By alternate pressure exerted by the left leg or arm and of the right leg or arm, a smooth movement thus arises, which is comparable to the course of movement in climbing stairs or climbing mountains, and both the arm and leg musculature as well as the back, chest and shoulder musculature are stressed. Treading surfaces (48, 49) always remain horizontal, so that there is no danger that a foot could twist. The sports device according to the invention can be equipped with a step counter, in order to determine the number of forward and reverse motions that have been completed.

This course of motion also occurs if treading surfaces 48, 49 and hand grips 65, 66 are attached directly to the longitudinal or cross bars of parallelogram 20.

Figure 7:
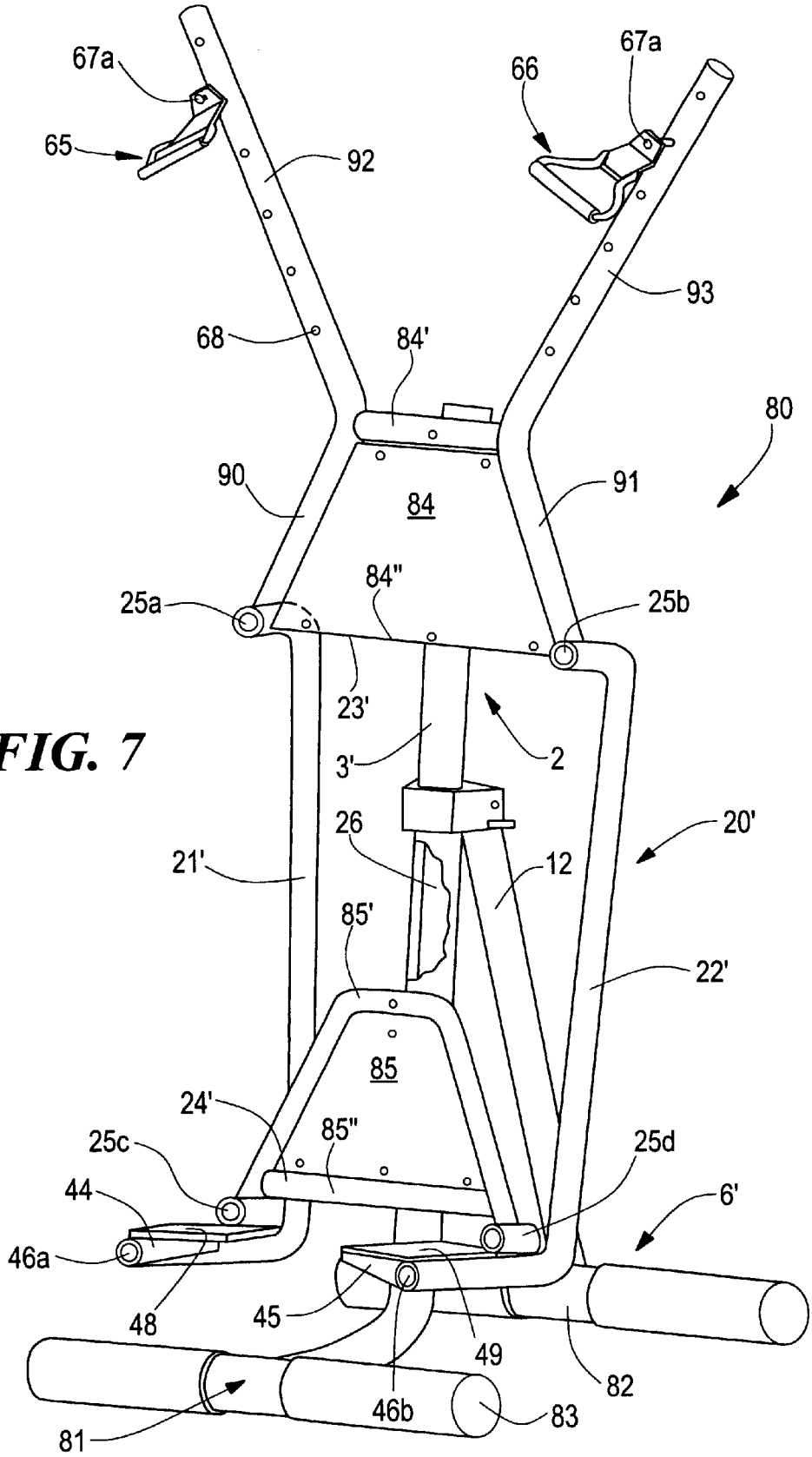
FIG. 7 shows a schematic representation of a second form of embodiment of the present invention with a parallelogram, whose upper and lower cross bars are designed in a compact manner.
Figure 8:
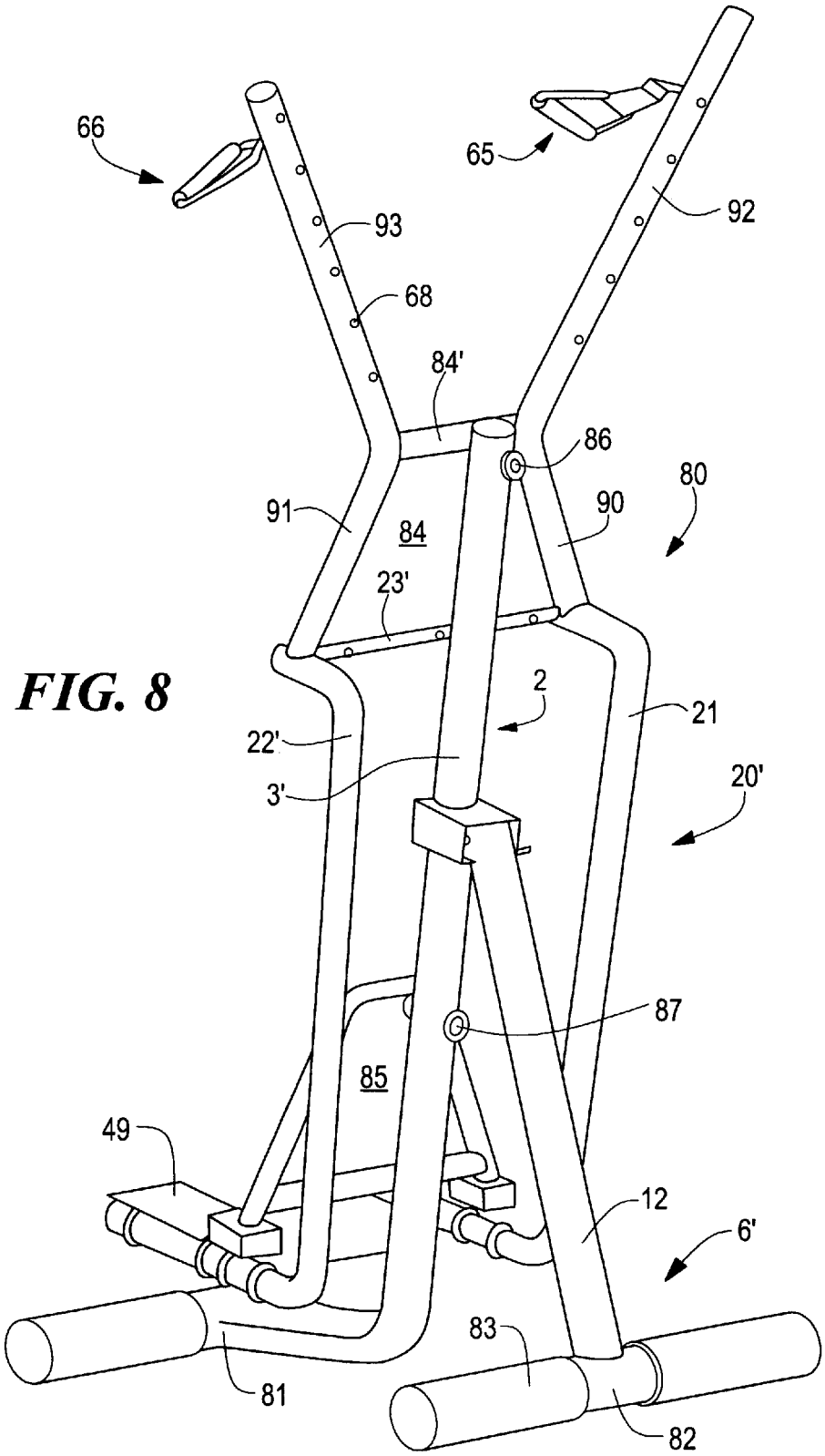
FIG. 8 shows a back view of the sports device of FIG. 7.

FIGS. 7 and 8 show schematically another embodiment 80 of the sports device according to the invention. Features, which are identical with those of the first form of embodiment, are provided with the same reference numbers.

Sports device 80 shown in FIGS. 7 and 8 also has a mounting frame in the form of a support frame 2, which bears the other components. Support frame 2 is also comprised here essentially of a vertical holding rod 3' and a pedestal 6'. Pedestal 6' has two foot parts 81, 82, which bear rubber coatings 83 resistant to sliding at their ends. The vertical holding rod 3' is made up in one piece. A back support 12 is attached from behind to the vertical mounting rod 3. Vertical mounting rod 3' and back support 12 converge in one piece into pedestal 6'.

Sports device 80 also has a parallelogram 20' with a left longitudinal bar 21', a right longitudinal bar 22', an upper cross bar 23' and a lower cross bar 24'. In this way, cross bars 23', 24' are configured in the form of the base edge of trapezoidal components 84, 85 each time. Longitudinal bars 21', 22' and cross bars 23', 24' are joined with one another at their ends in a moveable manner via bearings 25*a*–25*d*. The course of movement is the same as described for the first embodiment.

The resistance or the weight, against which parallelogram 20' is moved, as described above for the first embodiment, is integrated into the vertical mounting rod. The transfer of force is produced by means of bearings 86, 87 each time. Bearings 86, 87 join the upper narrow edges 84', 85' of each trapezoidal component 84, 85 with the vertical mounting rod. They correspond to bearings 30*a*, 30*b* and 33*a*, 33*b* in the first example of embodiment, which join the cylinders 26, 27 serving there as the resistance with the vertical mounting rod 3 or the lower cross bar 24 of parallelogram 20. Bearing 86 simultaneously defines the axis of rotation D1, while bearing 87 defines the axis of rotation D2 (see FIGS. 2*a*, 3*a*). The restoring force exercised by the hydraulic resistance also integrated into the vertical mounting rod 3' is manually controllable by a control mechanism (not shown).

The lower cross bar 24' of parallelogram 20' is, as already mentioned, simultaneously a part of a trapezoidal component 85. The wide lower edge 85" of the trapezoid forms the lower cross bar 24' of parallelogram 20'. Two footrests 44, 45 are attached in a rotatable manner at bearings 46*a*, 46*b* on edge 85". A treading surface 48, 49 is attached to each footrest 44, 45.

The upper cross bar 23' of parallelogram 20' is simultaneously part of another trapezoidal component 84. The wide lower edge 84" of the trapezoid forms the upper cross bar 23' of parallelogram 20'.

Lateral edges 90, 91 of the upper trapezoidal component are elongated outwardly in a V shape at their upper end approximately at the level of the narrow upper edge 84' of the trapezoid. Two hand grips 65, 66 are attached in a rotatable manner, as already described, by means of bearings 67*a*, 67*b*, on the resulting mounting rods 92, 93. Mounting rods 92, 93 are provided with through boreholes 68, into which bearings 67*a*, 67*b* are inserted and fixed. Several through boreholes 68 are provided, so that hand grips 65, 66 are adjustable in height and can be adapted to the size of the person who uses the sports device 80.

Sports device 80 can be utilized in the same way as sports device 1, i.e., by loading the right arm and the right leg against the restoring force exercised by the resistance integrated into vertical mounting rod 3', a backward motion of the right longitudinal bar 22' of parallelogram 20' is forced, which leads to a corresponding forward motion of the left longitudinal bar 21' and to the corresponding inclination of cross bars 23', 24'. In this way, the trapezoidal components 84, 85 are rotated in the clockwise direction around their axes of rotation D1, D2. This leads to a backward movement of the right hand grip 66 and the right footrest 45 or treading surface 49 and to a forward movement of left hand grip 65 and left footrest 44 or treading surface 48. The motion runs the reverse way, if the left arm and the left leg are loaded. Then a forward motion of the right longitudinal bar 22' of parallelogram 20' is forced against the restoring force exercised by the resistance integrated in the vertical mounting rod 3'. This leads to a corresponding backward motion of the left longitudinal bar 21' and to the corresponding inclination of cross bars 23', 24'. In this way, the trapezoidal components 84, 85 are rotated in the counterclockwise direction around their axes of rotation D1, D2. This leads to a forward movement of the right hand grip 66 and the right footrest 45 or treading surface 49 and to a backward movement of the left hand grip 65 and the left footrest 44 or treading surface 48. By alternate loading of the left leg or arm and of the right leg or arm, there is a smooth movement, which is comparable to the course of movement for climbing stairs or climbing mountains, and both the arm and leg musculature as well as the back, chest and shoulder musculature can be worked.

Equivalents

Those skilled in the art will be able to ascertain many equivalents to the specific embodiments described herein. Such embodiments are intended to be encompassed by the following claims.

What is claimed is:

1. A device comprising a stationary mounting frame adapted to be seated on a surface and a parallelogram movably mounted on said stationary mounting frame, said parallelogram having a left and a right longitudinal bar and an upper and a lower cross bar, wherein the longitudinal bars are movable vertically and parallelly to one another against at least one resistance or weight, wherein a left hand grip and a left treading surface are mechanically coupled to the left longitudinal bar, and a right hand grip and a right treading surface are mechanically coupled to the right longitudinal bar, in such a way that the movement of the parallelogram results in a forward movement of the left hand grip and the left treading surface, and backward movement of the right hand grip and the right treading surface.

2. The device according to claim 1, wherein the left hand grip and the left treading surface are attached in a rotatable manner to the left longitudinal bar, and the right hand grip and the right treading surface are attached in a rotatable manner to the right longitudinal bar of the parallelogram.

3. The device according to claim 1, wherein the hand grips are attached in a rotatable manner to the upper cross bar, and the treading surfaces are attached in a rotatable manner to the lower cross bar of the parallelogram.

4. The device according to claim 1, further comprising at least one upper mounting element attached in a rotatable manner to the upper cross bar of the parallelogram and at least one lower mounting element attached in a rotatable manner to the lower cross bar of the parallelogram, and wherein the hand grips are attached in a rotatable manner to the at least one upper mounting element and the treading surfaces are attached in a rotatable manner to the at least one lower mounting, element.

5. The device according to claim 4 wherein the upper mounting element and the lower mounting element comprise an upper or lower mounting rod running parallel to the upper or lower cross bars of the parallelogram.

6. A device comprising a stationary mounting frame adapted to be seated on a surface, a parallelogram movably mounted on said stationary mounting frame, said parallelogram having a left and a right longitudinal bar and an upper and a lower cross bar, wherein the longitudinal bars are movable vertically and parallelly to one another against at least one resistance or weight, wherein a left hand grip and a left treading surface are mechanically coupled to the left longitudinal bar, and a right hand grip and a right treading, surface are mechanically coupled to the right longitudinal bar, in such a way that the movement of the parallelogram results in a forward movement of the left hand grip and the left treading surface, and backward movement ofthe right hand grip and the right treading surface, an upper mounting element attached in a rotatable manner to the upper cross bar of the parallelogram and a lower mounting, element attached in a rotatable manner to the lower cross bar of the parallelogram, wherein the hand grips are attached in a rotatable manner to the upper mounting, element and the treading surfaces are attached in a rotatable manner to the lower mounting element and wherein the upper mounting element comprises two upper mounting rods which form the legs of an upper triangle, and the lower mounting element comprises two lower mounting, rods which form the legs of a lower triangle.

7. The device according to claim 6 wherein the triangles are isosceles or equilateral triangles.

8. The device according to claim 7 wherein the triangles are oriented with the apexes toward one another.

9. The device according to claim 6 wherein the lower triangle further comprises a base, said base also forming the lower cross bar of the parallelogram.

10. The device according to claim 6 wherein the legs of the upper triangle are attached in a rotatable manner to the upper cross bar of parallelogram.

11. The device according to claim 6 wherein the upper and the lower triangle each further comprise a cross-carrying beam which is held in a rotatable manner against a bearing socket provided on the mounting frame.

12. A device comprising a stationary mounting frame adapted to be seated on a surface, a parallelogram movably mounted on said stationary mounting frame said parallelogram having a left and a right longitudinal bar and an upper and a lower cross bar, wherein the longitudinal bars are movable vertically and parallelly to one another against at least one resistance or weight, wherein a left hand grip and a left treading surface are mechanically coupled to the left longitudinal bar, and a right hand grip and a right treading surface are mechanically coupled to the right longitudinal bar, in such a way that the movement of the parallelogram results in a forward movement ofthe left hand grip and the left treading surface, and backward movement of the right hand grip and the right treading surface, an upper mounting element attached in a rotatable manner to the upper cross bar of the parallelogram and a lower mounting element attached in a rotatable manner to the lower cross bar of the parallelogram, wherein the hand grips are attached in a rotatable manner to the upper mounting element and the treading surfaces are attached in a rotatable manner to the lower mounting element, wherein the upper mounting element comprises an upper mounting rod running parallel to the upper cross bar of the parallelogram and the lower mounting element comprises a lower mounting rod running parallel to the lower cross bar of the parallelogram, and wherein the lower mounting element further comprises a buttress having at least one roller which can be moved against a rolling surface attached to the stationary mounting frame wherein said buttress is disposed on the lower mounting rod.

13. A device comprising a stationary mounting frame adapted to be seated on a surface, a parallelogram movably mounted on said stationary mounting frame, said parallelogram having a left and a right longitudinal bar and an upper and a lower cross bar, wherein the longitudinal bars are movable vertically and parallely to one another against at least one resistance or weight, wherein a left hand grip and a left treading surface are mechanically coupled to the left longitudinal bar, and a right hand grip and a right treading surface are mechanically coupled to the right longitudinal bar, in such a way that the movement of the parallelogram results in a forward movement of the left hand grip and the left treading surface, and backward movement of the right hand grip and the right treading surface, an upper mounting element attached in a rotatable manner to the upper cross bar of the parallelogram and a lower mounting element attached in a rotatable manner to the lower cross bar of the parallelogram, wherein the hand grips are attached in a rotatable manner to the upper mounting element and the treading surfaces are attached in a rotatable manner to the lower mounting element, and wherein each of the upper and lower mounting elements is trapezoidal and has a wide lower edge, side wide lower edge of the upper mounting element forming the upper cross bar of the parallelogram and side wide lower edge of the lower mounting element forming the lower cross bar of the parallelogram.

14. The device according to claim 13 wherein the upper trapezoidal component has two mounting rods to which are attached hand grips.

15. The device according to claim 14 wherein the hand grips are adjustable in height, and wherein the treading surfaces are axially adjustable.

16. The device according to claim 1 wherein the mounting frame comprises a vertical mounting rod and a pedestal.

17. The device according to claim 1 wherein the resistance or weight is adjustable or controllable.

18. The device according to claim 1 wherein the weight comprises one or more pneumatic or hydraulic cylinders and wherein one end of each cylinder is attached to the stationary mounting frame and the other end of each cylinder is attached to the parallelogram, or to an upper mounting element attached to the parallelogram or to a lower mounting element attached to the parallelogram.

19. The device according to claim 16 wherein the at least one resistance or weight is intergrated into the vertical mounting rod.

* * * * *